United States Patent [19]

Weiss

[11] 4,358,653

[45] Nov. 9, 1982

[54] COMBINATION MICROWAVE OVEN

[75] Inventor: Bernard J. Weiss, Barto, Pa.

[73] Assignee: Raytheon Company, Lexington, Mass.

[21] Appl. No.: 153,982

[22] Filed: May 27, 1980

Related U.S. Application Data

[63] Continuation of Ser. No. 855,051, Nov. 25, 1977, abandoned.

[51] Int. Cl.[3] ..... H05B 6/72

[52] U.S. Cl. ..... 219/10.55 B; 219/10.55 D; 219/10.55 F

[58] Field of Search ..... 219/10.55 R, 10.55 F, 219/10.55 B, 10.55 M, 10.55 D

[56] References Cited

U.S. PATENT DOCUMENTS

| | | | |
|---|---|---|---|
| 3,436,507 | 4/1969 | Puschner | 219/10.55 F |
| 3,936,627 | 2/1976 | Fitzmayer | 219/10.55 F |
| 4,027,133 | 5/1977 | Dygve et al. | 219/10.55 F |
| 4,028,520 | 6/1977 | Torrey | 219/10.55 F |
| 4,028,521 | 6/1977 | Uyeda et al. | 219/10.55 B |
| 4,092,513 | 5/1978 | Rasmussen | 219/10.55 F |
| 4,105,886 | 8/1978 | Baron et al. | 219/10.55 F |
| 4,122,323 | 10/1978 | Staats | 219/10.55 F |
| 4,137,442 | 1/1979 | Tateda | 219/10.55 D |

FOREIGN PATENT DOCUMENTS

| | | | |
|---|---|---|---|
| 1070311 | 12/1959 | Fed. Rep. of Germany | 219/10.55 F |
| 1515070 | 6/1969 | Fed. Rep. of Germany | 219/10.55 F |
| 2410105 | 9/1974 | Fed. Rep. of Germany | 219/10.55 F |
| 2312165 | 12/1976 | France | 219/10.55 F |
| 52-58143 | 5/1977 | Japan | 219/10.55 F |

*Primary Examiner*—Arthur T. Grimley

*Attorney, Agent, or Firm*—William R. Clark; Milton D. Bartlett; Joseph D. Pannone

[57] ABSTRACT

A combination microwave and electrically heated oven having a door with a high temperature seal which inhibits the escape of hot gases around the periphery of the door and which is isolated from the major portion of the electric fields of the microwave energy entering the space between the door and the oven aperture walls by a slotted choke microwave seal so that the vapor seal may be formed which high microwave energy absorption characteristics without either reducing the intensity of microwave energy in the oven or causing substantial heating of the vapor seal by microwave energy.

10 Claims, 6 Drawing Figures

COMBINATION MICROWAVE OVEN

CROSS-REFERENCE TO RELATED CASES

This is a continuation of application Ser. No. 855,051, filed Nov. 25, 1977 now abandoned.

CROSS REFERENCE TO RELATED APPLICATIONS

Application Ser. No. 754,064 filed Dec. 23, 1976, by Wesley W. Teich now abandoned and application Ser. No. 847,863 filed Nov. 2, 1977, now abandoned by Bernard J. Weiss both assigned to the same assignee as this application are hereby incorporated by reference and made a part of this disclosure.

BACKGROUND OF THE INVENTION

Combination microwave and electrically heated ovens have been used in which calrod electric heaters are positioned in the oven and microwave energy has been radiated into the oven with vapor seals around the periphery of the door to prevent the emission of hot gases from the oven. Such hot vapor seal structures have not completely prevented the escape of microwave energy from the oven around the door. Hence, additional energy sealing structure had to be added outside the oven and vapor seal.

SUMMARY OF THE INVENTION

This invention discloses the discovery that a microwave oven having a door seal structure incorporated with a conventional high temperature gas vapor seal for a combination oven will absorb as much as several hundred watts of microwave energy in the vapor seal, thereby reducing the microwave power in the oven. Such seal heating may be reduced by placing microwave choke seal structure between the vapor seal and the oven interior. More specifically, this invention discloses an oven door combination wherein the door has a portion inset into the periphery of the oven opening and spaced from the peripheral walls of said opening and forming therewith a first low microwave energy dissipation seal comprising an input transmission line structure extending from the interior oven to a junction with a microwave energy choke structure. In accordance with this invention, the choke structure may be formed either in the door or in the oven wall and provides a high impedance in series with the input transmission line structure at the predominant operating frequency range of the microwave oven, such as, for example, between 2.4 to 2.5 KMH.

In accordance with this invention, a high temperature vapor seal is positioned adjacent the choke junction and comprises a resilient conductive structure contacting peripheral regions of the oven wall and of the door. More specifically, such a structure may comprise a tubular wire mesh of fine wire stainless steel which provides effectively a low impedance output transmission line terminating the input transmission line and high impedance choke section combination at the predominant microwave frequency and in a microwave energy dissipative load to substantially entirely absorb the low amounts of microwave the low amounts of microwave radiation which may leak through the first microwave seal.

In accordance with this invention, the walls of the oven are preferably made of conventional steel coated with a high temperature ceramic such as enamel so that microwave energy being transmitted in the region between the steel mesh seal and the oven wall through the thin enamel coating will be absorbed by the oven walls, the wire mesh, or in the enamel.

In accordance with this invention, additional resiliency may be provided for the resilient seal by supporting the wire mesh in tubular form on a tubular fiberglass braid in turn supported on a tubular steel mesh structure of greater diameter wire to provide spring action.

In accordance with this invention, sealing action of the microwave energy in the predominant frequency range may be enhanced by providing means in the input transmission line section of the first seal for inhibiting transmission of such microwave energy periphery around the said input transmission line structure. More specifically, such means may comprise impedance discontinuities such as slots in one of the walls of said input transmission line structure. Further in accordance with this invention, such slots preferably extend through the wall into the choke structure to further assist in inhibiting periphery mode propagation in the choke structure. Such a microwave energy sealing structure allows substantially all of the microwave energy in the oven impinging on the sealing structure to be reflected back into the oven since it presents a very low impedance at the point in the oven where microwave energy impinges on the input transmission line structure and such low impedance occurs even though the input transmission line structure presents a substantial air gap so that ovens may be manufactured with substantial tolerances for the oven and door parts. In addition, possibility of arcing due to the microwave energy fields is eliminated even when the oven is operated at high temperature where ionization of gases from a body being heated might otherwise ionize at the vapor seal with lower electric field gradients.

In accordance with this invention, a food body may be positioned on a rack in the radiation patterns from rotating radiator so that a substantial portion of the microwave energy is absorbed on passing through the food body prior to reflection from walls of the oven. Therefore, high efficiency heating may be achieved with microwave energy even though the walls of the oven are made of inexpensive material such as enamelled steel. In accordance with this invention, the magnetron may be tightly coupled to the oven through a coupling mechanism such as a waveguide and coaxial transition thereby increasing the efficiency of conversion of input power electrical energy to microwave energy coupled into the body to be heated. More specifically, in the case of light loads or if the oven is energized with no food body positioned therein, microwave energy radiation into the oven and reflected back to a multi-port rotating radiator from the opposite wall such as the top wall of the oven will arrive at a common junction such as the central conductor of a coaxial line transition with substantially different phases so that relatively low amounts of energy are coupled back into the magnetron and large portions of the energy are reflected back into the oven where the energy is absorbed by the walls of the oven, and the vapor seal is protected from the strong microwave field by the choke action of the first microwave seal on the door.

In addition, electric resistance heaters may be positioned directly in the oven extending through microwave chokes in the oven wall for supplying conventional heat to the oven for cooking, broiling, or cleaning.

BRIEF DESCRIPTION OF THE DRAWINGS

Other and further objects and advantages of this invention will be apparent as the description thereof progresses reference being had to the accompanying drawings wherein.

DESCRIPTION OF THE PREFERRED EMBODIMENT

Figure 6:
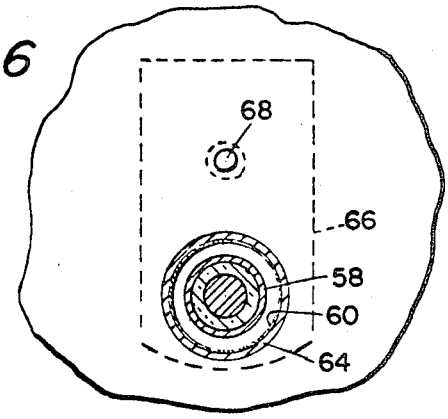
FIG. 6 illustrates a fragmentary cross-sectional view of the portion of the oven taken along line 6—6 of FIG. 1.
Figure 1:
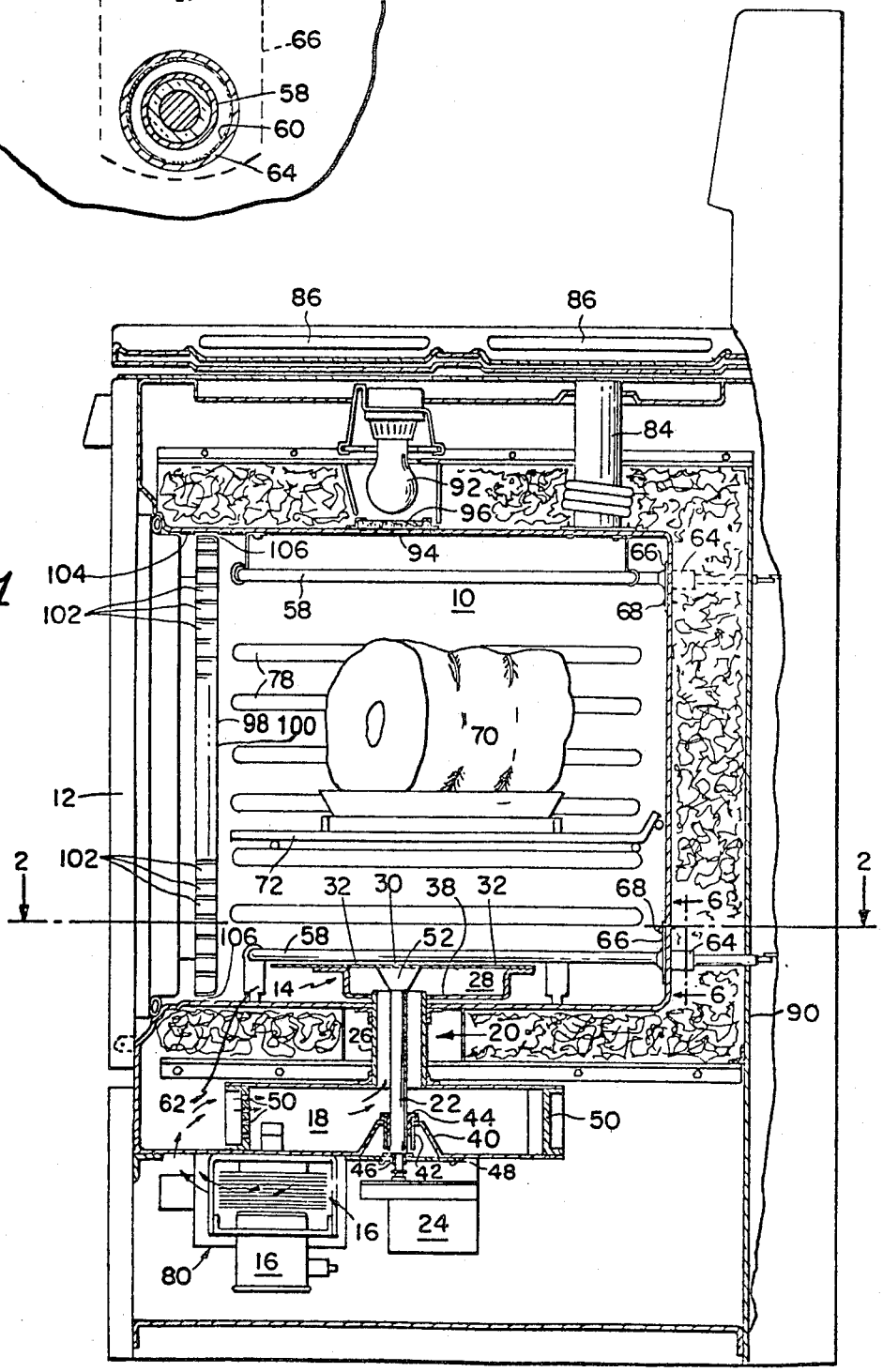
FIG. 1 illustrates a vertical sectional view of a combination microwave oven embodying the invention with the door closed.
Figure 2:
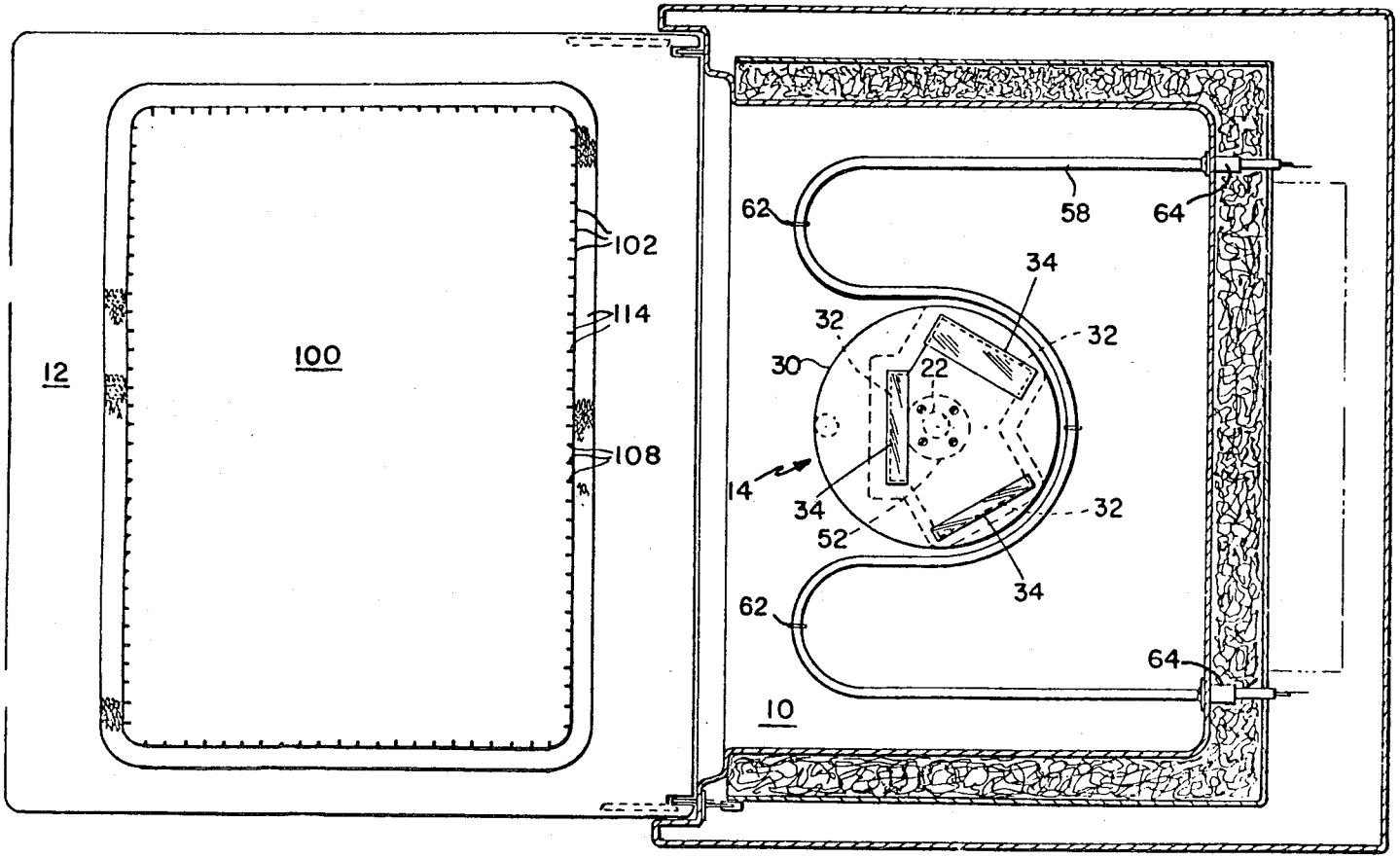
FIG. 2 illustrates a horizontal sectional view of the oven illustrated in FIG. 1 taken along line 2—2 of FIG. 1 but with the door open.
Figure 3:
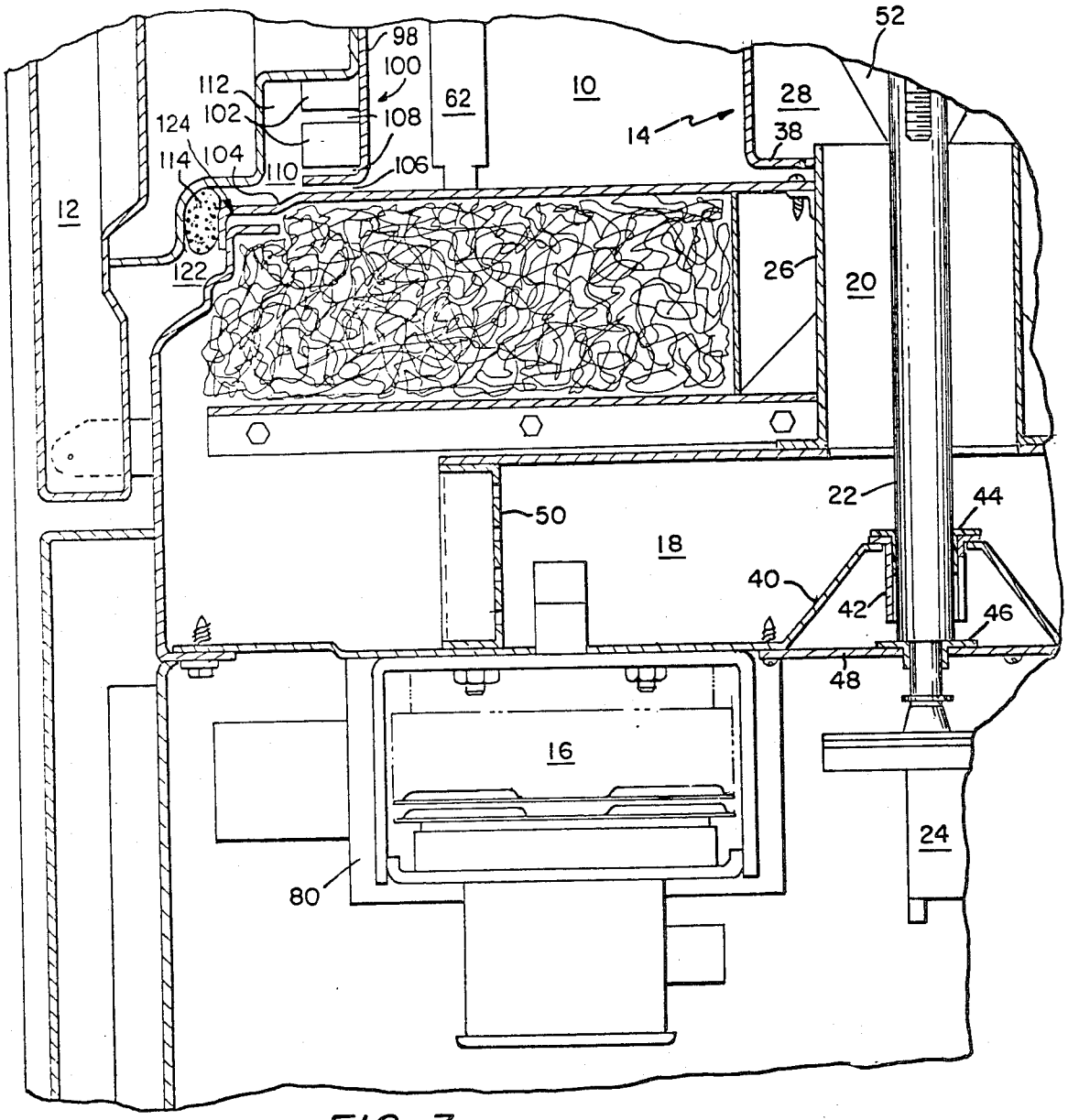
FIG. 3 illustrates a fragmentary expanded portion of FIG. 1.

Referring now to FIGS. 1, 2, and 3, there is shown a microwave cavity 10 closed by a door 12 and supplied with microwave energy from a rotating radiator 14 in the bottom of the oven. Radiator 14 is fed with microwave energy from a magnetron 16 through a waveguide 18 and a coaxial line 20 having a central conductor 22 rigidly connected to rotating radiator 14 and extending through waveguide 18 to a gear reduction motor 24. Motor 24 is attached to the bottom of waveguide 18 and rotates central conductor 22 to rotate radiator 14. Coaxial line 20 has an outer conductor 26 rigidly connected to the upper wall of waveguide 18 and extending through the bottom wall of enclosure 10 into a plenum 28 in radiator 14.

As shown more specifically in FIG. 2, plenum 28 comprises an upper plate 30 connected to central conductor 22 and having a plurality of ports 32 therein spaced at different distances at the axis of conductor 22. Microwave energy is radiated from plenum 28 into the oven enclosure 10 through ports 32 which are covered by ceramic members 34 and, hence, are transparent to microwave energy and prevent dust and cooking particles from entering the plenum 28.

A lower plenum cover 38 of radiator 14, which prevents radiation of microwave energy radially outwardly and directs it through the ports 32, and the lower surface of cover 38 is positioned sufficiently above the bottom wall of enclosure 10 for radiator 14 to rotate freely. An aperture in cover 38 surrounds the upper end of outer coaxial conductor 26 which thus extends slightly into plenum 28 thereby substantially preventing microwave energy from radiating into enclosure 10 from beneath radiator 14. The length of outer conductor 26 which extends into plenum 28 may be adjusted to improve impedance matching conditions.

As shown in FIG. 3, a substantially conical waveguide to coaxial line transition member 40 is formed by die-stamping the sheet metal bottom wall of guide 18 upwardly in conical shape surrounding central conductor 22. A tubular member 42 is welded to the top of conical member 40 and extends downwardly surrounding conductor 22 for distances equal to an effective electrical quarter wavelength at the frequency of magnetron 16 so that it produces a choking action to energy attempting to escape from waveguide 18 toward motor 24. A sleeve bearing 44 of dielectric material is positioned between tubular member 42 and conductor 22 to insure against arcing in the bearing.

Shaft 22 is reduced in diameter just below the lower end of tubular member 42 producing a land resting on an oil-filled bronze bearing 46 supported in a plate 48 which attaches motor 24 to the bottom of guide 18.

The ends of waveguide 18 are closed by shorting members 50 which are positioned to provide a substantially flat standing wave ratio between the output probe of magnetron 16 and central conductor 22.

As shown in FIGS. 1 and 2, radiator ports 32 are each fed with microwave energy through separate waveguide sections whose axes are at 120° to each other and whose inner ends form a common junction region containing the central conductor 22. An impedance matching conical member 52 is connected to conductor 22 to increase its radius as it approaches upper plate 30 of plenum 28. Waveguides have side walls forming the sides of plenum 28 and are of different lengths which the maximum length difference being on the order of $\lambda/3$ or less to that energy radiated into plenum 28 from central conductor 22 arrives at ports 32 in respectively different phases. Since the width of guides is selected to be between $2/3\lambda$ and $\lambda$, the primary mode excited in waveguides is the $TB_{1\text{-}0}$ mode; and since the ports 32 are slots extending across the guides, the radiation patterns radiated from each of the ports will have different polarizations.

Energy reflected back to the ports 32, for example, from the top wall of the microwave cavity 10 will couple into the ports 32 dependent upon the polarization and will propagate toward the common junction at central conductor 22. However, as a result of the different distances that the waves travel, which distance differences are double the length differences of waveguides forming plenum 28, the waves will arrive at central conductor 22 in different phases preferably selected so that substantial cancellation of the electrical field vector will occur thereby causing this junction of the waveguides at central conductor 22 to reflect such energy back through ports 32 into the cavity. As a result, a substantial isolation of the magnetron from reflected waves occurs. Furthermore, while this effect is preferably chosen to be maximized when the microwave cavity has no food body positioned therein and the geometry of the oven is fixed, substantial amounts of cancellation will occur for light loads such as small food bodies which do not absorb substantially all the microwave radiation on the first pass of the microwave energy through the food body. Under these conditions it, therefore, is possible to couple magnetron 16 to the oven cavity 10 as tightly as possible thereby allowing magnetron 16 to operate close to its maximum efficiency for converting its electrical energy input to microwave energy output while maintaining low microwave energy field gradients and, hence, low wall losses in the waveguide 18.

A more complete description of this radiating system may be found in copending application Ser. No. 847,863 filed Nov. 2, 1977 by Bernard J. Weiss for a Combination Microwave Oven.

In accordance with this invention, oven cavity 10 may be made of relatively lossy or energy absorbing material which may absorb, for example, a few percent of microwave energy impinging thereon and reflecting therefrom. Such material may be, for example, conventional sheet steel used in conventional ovens and coated with conventional enamel, all in accordance with well-known practice. In addition, conventional broiler and heating units 58 may be positioned adjacent the upper and lower walls of the cavity 10 held by conventional fastners 62 in accordance with well-known practice. However, in the case of the heating unit 58, it preferably is formed in arcuate shape so that its closest portion is positioned around, and spaced from, the periphery of radiator 14 so as not to interfere with the pattern of microwave energy radiated therefrom.

In accordance with this invention, elements 58 are calrod units which extend through the back wall of cavity 10. The outer covering of the calrod units are grounded to the wall of cavity 10 by tabs 66 which are attached, for example, by welding or crimping to the calrod unit and which are screwed to the back wall of cavity 10 by screws 68. Tubular elements 64, whose lengths are preferably an effective quarter wavelength the microwave frequency in cavity 10, are attached by welding to the outside of oven wall 10 and surrounding the calrod unit spaced therefrom by an enamel coating 60 on element 64. Thus, microwave energy is prevented from escaping from the oven 10 through the space between the outer surface of the elements 58 and the inner surface of tubular elements 64 due to the choking action of tubular members 64. Electrical connections to power and control terminals may be made to the calrod heater and broiler units in accordance with well-known practice.

A food body 70 may be positioned, for example, on a rack 72 above radiator 14 in a dish 74 preferably transparent to microwave energy and resting on a plate 76 of material which is transparent to microwave energy such as pyroceram. Rack 72 may be, for example, a welded wire rod having apertures substantially greater than $\lambda/2$ and adjustably supported at different levels in cavity 10 by means of grooves 78 in the side walls of cavity 10 or in any other desired manner.

Any desired configuration can be used for the radiator 14. An example providing good results at 2.45 KMH using waveguides which are 4 inches wide and 1 inch high. fed by a central conductor 22 which is $\frac{1}{2}$ inch in diameter and an outer conductor 26 which is 2 inches in diameter, having lengths of 1 inch, $3\frac{1}{4}$ inches, and 2 inches from the axis of conductor 22 feeding ports 32 having widths of $\frac{1}{2}$ inch, $\frac{1}{4}$ inch, and 1 inch respectively. The waveguide 18, which may also be 4 inches wide, is shown as 2 inches high and the distances from one shorting member 50 to the center of magnetron output to the axis of conductor 22 and to the other shorting plate 50 are $\frac{3}{4}$ inch, 5 inches, and $10\frac{1}{4}$ inches respectively. Additional explanation of radiator 14 may be found in the aforementioned Teich application.

Air from a blower 80 is blown in a conventional manner through the cooling fins of magnetron 16 and then into oven 10, for example, through waveguide 18 via apertures 82 in shorting plates 50, transmission line 20 and the space between outer conductor 26 and the aperture in plate 38 where the air circulates past calrod heater 58 to conduct that air past food body 70 during cooking. The air then exits through a canister 84 at the top of the oven to the center of a surface burner unit 86.

During the oven's self-cleaning cycle with food body 70 removed, the temperature of the oven is raised to 750° F.-1000° F. by energizing lower calrod unit 58 to vaporize deposits on the wall of oven 10 and to blow the vapor out through canister 84 which may contain a catalyst to complete oxidation of the vapor in accordance with well-known practice.

Thermal insulation 88 of, for example, fiberglass is provided around oven 10 in a well-known manner surrounded by a metal skin 90. A light 92 may illuminate oven 10 through an apertured metal plate 94 covered with a pyrex plate 96.

In accordance with this invention, door 12 has a high temperature vapor which is prevented from absorbing large amounts of microwave energy from the interior of enclosure 10 by a microwave seal positioned between said enclosure interior and the vapor seal. The first microwave seal, as shown in FIG. 3 comprises a slotted choke structure using the principles described in U.S. Pat. No. 3,767,884 by Osepchuk et al in which the door is formed to have portion 98 inset into the peripheral regions 104 of the oven aperture. Portion 98 comprises a plate 100 attached to the door 12 by welding and formed of material such as sheet steel covered with enamel. Edges 102 of plate 100 are bent at right angles to plate 100 so that they are parallel to the aperture regions 104 of the oven and are spaced slightly therefrom to form an input microwave transmission line section 106. Portions 102 are preferably approximately one quarter wavelength long at the frequency of magnetron 16 and are separated by spaces formed as slots 108 in the edges of sheet metal plate 100 and acting as impedance discontinuities to microwaves attempting to travel peripherally along the door, hence, such wave transmission is inhibited.

Microwaves travelling outwardly through transmission line section 106 arrive at a junction region 110 where transmission line 106 is coupled to a resonant choke section 112 which may be regarded as a quarter wave choke section having a short circuit at the inner side of plate 100 so that the total distance from the short circuiting plate 100 inside the choke structure 102 along the edges 102 through the junction region 110 and back along transmission line section 106 to the interior of the oven is approximately one-half wavelength at the frequency of magnetron 16 and, therefore, the input to transmission line 106 is a low impedance. In addition, choke section 102 may be regarded as a high impedance at the microwave frequency which is coupled to region 110 effectively in series with input section 106 so that even if the input section 106 is other than one quarter wavelength long, substantial microwave sealing occurs. Such a structure because the door 12 is inset may have the door moved substantially, for example, a quarter of an inch or more without substantially altering the resonant nature of the choke structure of the sealing effect of this slotted choke sealing structure to microwaves.

Figure 4:
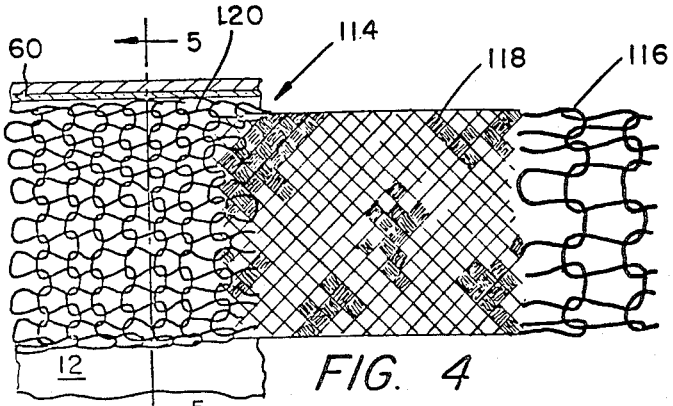
FIG. 4 illustrates a fragmentary view of the vapor seal of FIGS. 1, 2, and 3.
Figure 5:
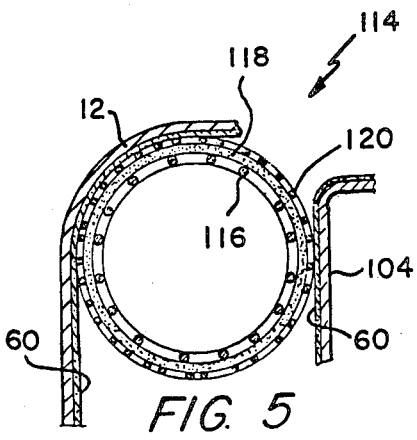
FIG. 5 illustrates a sectional view of the vapor seal of FIG. 4 taken along line 5—5 of FIG. 4.

In accordance with this invention, a high temperature vapor seal region 122 is provided between door 12 and wall regions 104 adjacent to region 110. This region may be regarded for the purposes of this invention as the output transmission line section 124 of the combination microwave and vapor sealing structure. More specifically, vapor seal comprises a resonant structure 114 shown in greater detail in FIGS. 4 and 5. Member 114 has inner tubular member 116 of woven steel mesh which provides resiliency. Positioned over mesh 116 is a woven mesh of insulating material such as fiberglass 118 which protects steel mesh 116.

In accordance with a further aspect of this invention, additional microwave absorption is achieved by a third woven layer 120 positioned over fiberglass layer 118 and made of stainless steel mesh which contacts the enamel layer 60 both on the oven wall regions 104 and the door 12. Thus, it may be seen that additional sealing of microwave energy which may leak through the slotted choke either as harmonics or as low-level fundamentals can be substantially absorbed in the stainless steel mesh which due to its braided configuration presents a substantial absorption to microwave energy. The output transmission section 124, thus, comprises the thickness of the enamel coating 60 and, hence, is of low impedance having high surface wall currents to transmit energy. Thus in accordance with this invention, additional microwave sealing has been achieved in region 62.

This completes the description of the embodiments of the invention disclosed herein. However, many modifications thereof will be apparent to persons of ordinary skill in the art without departing from the spirit and scope of the invention. For example, the braided stainless steel mesh may be formed by other means than braiding and may be of materials other than stainless steel; other types of radiating structures may be used for supplying the oven 10 with microwave energy; and any desired system of controls may be used.

Accordingly, it is intended that this invention be not limited by the particular details disclosed herein except as defined by the appended claims.

What is claimed is:

1. In combination:

A microwave conductive cavity having an aperture in a wall thereof;

means for energizing said cavity with microwave energy;

an electrical resistive heater extending through said aperture into said cavity for heating the interior thereof;

said heater comprising an elongated resistive heating element;

said heater further comprising an outer conductor shielding said element from said microwave energy;

means for electrically connecting said outer conductor to said wall; and a tubular conductive choke member connected to said wall extending outwardly from said aperture surrounding a portion of said heater.

2. The combination in accordance with claim 1 wherein said electrical connecting means comprises a metal plate bonded to said outer conductor.

3. The combination in accordance with claim 2 wherein said plate is screwed to said wall.

4. The combination in accordance with claim 1 further comprising a porcelain enamel layer covering at least a portion of the inside surface of said wall.

5. The combination in accordance with claim 1 wherein said tubular conductive choke member has a length of approximately one-quarter of the wavelength of said microwave energy.

6. The combination in accordance with claim 1 wherein said tubular conductive choke member has an inner layer of porcelain enamel.

7. A combination microwave and electric oven comprising:

a microwave conductive cavity coated with porcelain enamel, said cavity having an access door and an aperture in the wall opposite therefrom;

means for energizing said cavity with microwave energy;

an electrical resistive heater extending through said aperture into said cavity for heating said cavity;

said heater comprising an elongated resistive heating element;

said heater further comprising an electrically insulating material covering said element;

said heater further comprising an outer conductor shielding said insulating material from microwave energy;

means for electrically connecting said outer conductor to said wall; and a tubular conductive choke member having its inside covered with porcelain enamel, said member being connected to said wall and extending outwardly from said aperture surrounding a portion of said heater.

8. The oven recited in claim 7 wherein said electrical connecting means comprises a metal plate bonded to said outer conductor.

9. The oven recited in claim 8 wherein said plate is screwed to said wall.

10. The oven recited in claim 7 wherein said tubular conductive choke member has a length of approximately one-quarter of the wavelength of said microwave energy.

* * * * *